United States Patent [19]

Carlson et al.

[11] Patent Number: 4,462,115

[45] Date of Patent: Jul. 31, 1984

[54] WOMAN'S PROTECTIVE UNDERGARMENT FOR VOLLEYBALL

[75] Inventors: Linda A. Carlson, North Platte; Steven R. Morgan, Ogallala, both of Nebr.

[73] Assignee: Volleyball World, Inc., Ogallala, Nebr.

[21] Appl. No.: 257,111

[22] Filed: Apr. 24, 1981

[51] Int. Cl.[3] ..... A41D 13/00

[52] U.S. Cl. ..... 2/2; 2/406; 2/403

[58] Field of Search ..... 2/22, 23, 222, 409, 2/400, 401, 402, 403, 406, 407, 2, DIG. 1; 128/518 R, 519, 528; D2/10, 11

[56] References Cited

U.S. PATENT DOCUMENTS

| | | | |
|---|---|---|---|
| 2,492,620 | 12/1949 | Cohen | 128/288 |
| 3,613,686 | 10/1971 | DeWoskin | 128/288 |
| 3,909,847 | 10/1975 | Holt et al. | 2/406 X |
| 4,009,495 | 3/1977 | Faust | 2/406 |
| 4,156,294 | 5/1979 | Horn | 2/409 X |

OTHER PUBLICATIONS

Frederick's Of Hollywood, Catalogue pp. 1 and 9, Dated Feb. 1966.

*Primary Examiner*—H. Hampton Hunter
*Attorney, Agent, or Firm*—Raymond N. Baker

[57] ABSTRACT

A lightweight, snug fitting, woman's protective undergarment for use in playing volleyball provides shock-absorbing pads integral with a panty brief to protect portions of the lower mid-section of the female anatomy subject to injury during floor impact, including the frontal hip portion (iliac crest), the bony prominence at the side (greater trochanter of the femur), and the bony prominence depicted by the dimples below the waist at the posterior (posterior superior iliac spine), while providing for access of air for cooling and hygienic evaporation of moisture from remaining portions.

4 Claims, 4 Drawing Figures

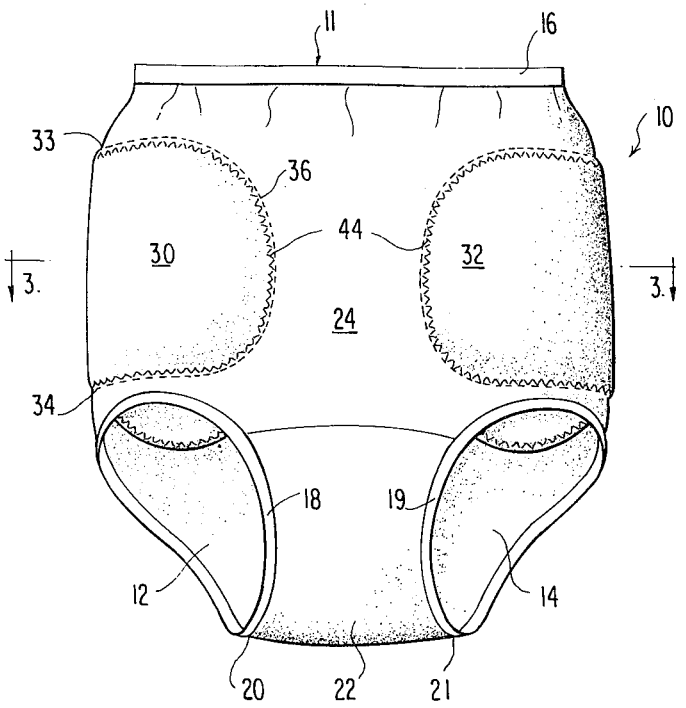
FIG. 1
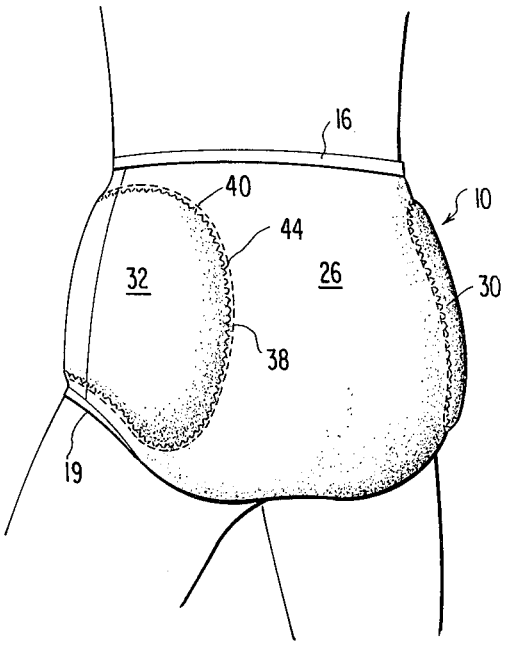
FIG. 2
FIG. 3
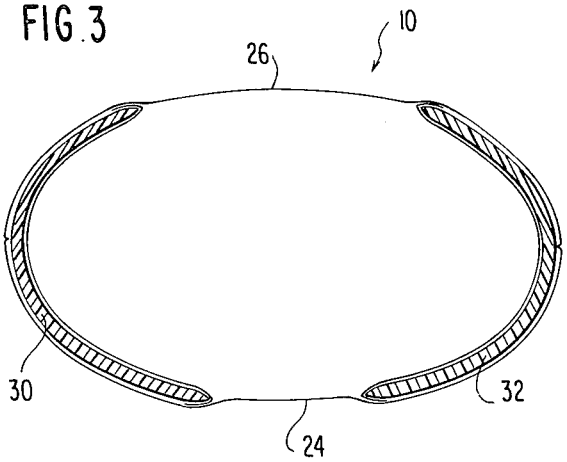
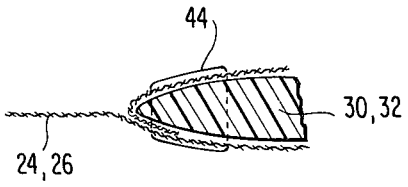
FIG. 4

WOMAN'S PROTECTIVE UNDERGARMENT FOR VOLLEYBALL

This invention is concerned with a woman's protective undergarment for use in playing volleyball and, more specifically, with a lightweight, comfortable, snugly fitting undergarment for preventing musculo-skeleton injuries during execution of maneuvers involving body-floor contact. Such protection is provided without inhibiting movement of the wearer and without hygienic detriment during usage.

Volleyball passing plays which are executed when the player is crouched low to get under the ball and with the player in an off-balance position amost inevitably result in floor impact. Rolling, tumbling or sprawling on the volleyball court thus becomes part of such defensive plays.

In a back roll, an effort is made to cushion the impact with the floor through the buttocks while leading into the roll. In the side roll, after hitting the ball, momentum will carry the player into a roll where the side of the hip can be used to cushion impact with the floor. In the sprawl, or front dive, the frontal portion of the hip often cushions impact with the floor. Prior to the present invention, there has been no volleyball gear available for reducing shock to those portions of a female player's anatomy in the general pelvic and hip area which are especially vulnerable to injury.

In addition to shock-absorbing protection, the invention provides a comfortable, snugly fitting and lightweight undergarment which can be comfortably worn under gym shorts without unattractive bulkiness. Freedom of movement of the wearer is provided while maintaining integral protective covering in position over such vulnerable areas during maneuvering.

In accordance with the invention, protection is selectively provided at the side of the hip at the greater trochanter of the femur (thigh bone) which has the greatest lateral prominence during a side roll; at the iliac crest (frontal hip), the bony prominence subject to first contact during a front dive; and, at the posterior superior iliac spine, the bony prominence depicted by the dimples in the lower back and most subject to injury during the back roll. The musculo-tendinous attachments in such frontal, lateral, and posterior areas are protected to reduce traumatic tendonitis injuries, strains, and sprains. Shock-absorbing impact protection is selectively provided at such vulnerable areas while allowing normal access of air for evaporation of perspiration and cooling in the area of the crotch and thereabove.

Hygienic detriment to the user is avoided by diminishing the likelihood of bacterial growth, allergic reactions due to skin irritation, and infections. The invention thus selectively provides protection for areas subject to floor-impact injury while maintaining optimum sanitary conditions to avoid hygienic detriment at other vital areas of the wearer.

These and other advantages and contributions of the invention are considered further in the description of the embodiment shown in the accompanying drawings. In these drawings:

FIG. 1 is a frontal view of the woman's volleyball protective undergarment of the present invention;

FIG. 2 is a perspective view of the embodiment of FIG. 1 taken from a position slightly angled to the left posterior of the wearer;

FIG. 3 is a cross-sectional view of FIG. 1 taken along lines 3—3; and FIG. 4 is a plan view of a portion of a protective pad at a peripheral edge showing the undulating stitching utilized as part of the invention.

Panty brief 10 of FIGS. 1 and 2 is shown in place in FIG. 2 as worn by a female volleyball player. Such undergarment 10 includes a waist opening 11 and leg openings 12 and 14.

Waistband 16 is at the upper periphery of the undergarment as worn and, leg bands 18 and 19 are at the thigh portions of the wearer. The interior edge portions 20, 21 of the leg bands are separated by crotch 22 of the undergarment. A front riser portion 24 extends from the crotch area to waistband 16 and a back riser portion 26 extends from the crotch area to the waistband 16 at the portion of the garment covering the posterior of the wearer.

Shock-absorbent pads 30 and 32 (shown in broken lines in FIGS. 1 and 2) are integral with panty brief 10 and, preferably, worn internally of brief 10 providing for a smooth exterior contour line. Protective pads 30, 32 are of extended surface area and extend over the side hip area from a location contiguous to waistband 16 at horizontally-oriented peripheral line 33 (FIG. 1) to a location contiguous to the exterior portions of thigh bands at horizontally-oriented line 34.

Protective pads 30, 32 extend toward the front riser portion 24 to a vertically-oriented peripheral line, such as 36 of pad 30, which is substantially vertically above the interior edge 20 of the thigh band at leg opening 18, and cover the frontal prominent portion of the ilium and musculo-tendinous attachments from this area.

Referring to pad 32 as shown in FIG. 2, the protective pads extend toward the rear panel riser portion 26 to a vertically-oriented peripheral line 38 which is substantially vertically above a centrally located portion of the thigh as viewed from the posterior of the wearer. At such posterior portion, the upper inward end 40 of the pad extends over the iliac crest covering the bony prominence depicted by the dimples in the lower back for preventing injury to the gluteus maximum muscles and avoiding strains and sprains to the attachment of the long dorsal sacroiliac ligament.

At the sides of the wearer, the protective pads 30, 32 extend over the upper portion of the thigh bone (femur) near where it joins the pelvic bone to protect such bony prominence and substantially reduce injuries to the gluteal muscle areas of the wearer.

A naturally adapted covering for the lower midsection is provided, with selective impact protection for injury-prone areas at the front, sides and posterior of the wearer, while optimizing air access for cooling and evaporation of perspiration from other vital areas of the wearer. Provision is made for upward movement of air from the crotch area 22, both frontal and posterior, via front ad rear riser portions 24, 26. In addition, the impact protection is provided without interfering with running and other thigh movements.

Panty brief 10 comprises a fabric having porous characteristics, preferably a woven fabric including cotton to facilitate access of air and evaporation of perspiration.

Pads 30 and 32 are formed from resilient shock-absorbent material, preferably high-density rubber or plastic, in sheet form, having tensile strength characteristics to resist tearing upon impact. A suitable shock-absorbing foam product is available in sheet form from Adams Plastics, Inc., Cookeville, Tennessee 38501; a thickness of about 3/16" has been found to provide desired protection while avoiding bulkiness. Greater thicknesses not substantially in excess of 5/16" can be used.

The protective pads are covered on their interior (body-contact) surface with a smooth, abrasion-free fabric such as nylon tricot. The fabric-covered pad is made integral with the brief on its interior surface. Preferably, the protective pads have a curvilinear configuration periphery to avoid sharp corners and, the thickness of the shock-absorbing material is tapered at the periphery.

Such pads are made integral by an undulating-type stitching, such as serpentine stitching, which can expand along its length dimension without straining the thread and, if broken, will not unravel. Use of such stitching, in sewing pads 30, 32 to brief 10, also provides a tapered edge at the periphery of the pads 30, 32 so that the exterior contour line appears substantially smooth when being worn. Further, serpentine stitching provides for width of coverage to assure holding strength when the foam shapes are provided with tapered edge peripheries. The generally curvilinear configuration of the perimeter of such pads provides for uniform stretching over body contours and enhances durability.

The configuration for the tapered edge protective pad is shown in FIGS. 3 and 4. This tapered edge profile continues about the full periphery of a pad and helps provide a smooth exterior contour line. Serpentine stitching 44 (FIG. 4) is used about the periphery to compress the edge portion of the foam to produce such tapered edge cross-sectional configuration. Such edge stitching has a width of about 3/16" and greater, but generally not in excess of about 5/16".

Another significant advantage is that this protective garment can be readily manufactured and ordered to fit the wearer using standard-size classifications. All members of a team can be readily and economically outfitted while maintaining the desired snug fit and trim appearance which are part of the aesthetic contribution of the game and its uniforms. The total weight from small through large size protective garments ranges between 2.2 to 2.8 ounces. The area of a protective pad, e.g. for a medium size protective garment, is approximately sixty (60) square inches.

Specific materials and dimensional and other characteristics have been set forth in order to provide a complete and comprehensive description of the illustrated embodiment of the invention for purposes of completeness. In the light of such disclosure, aspects such as the described materials can be changed without departing from the inventive concepts. Therefore, in evaluating the scope of the present invention, reference should be had to the appended claims.

We claim:

1. Woman's volleyball protective garment, capable of being worn under gym shorts, which provides for freedom of movement of the wearer without bulkiness and without blocking hygienic access of air for ventilation and evaporation of perspiration in the crotch and adjacent areas, comprising a panty-type brief for covering the lower midsection including the side, frontal, and posterior hip area from the waist downwardly extending to a portion of the upper thighs of the wearer, such brief including a waist opening at its upper periphery, leg openings at its lower periphery, a crotch front and rear risers extending from the crotch to the waist opening, and side hip-covering portions extending from the waist to upper thigh portions of the wearer, such brief comprising a fabric with porous characteristics for access of air and evaporation of perspiration, and shock-absorbing protective pads of extended surface area integral with such fabric, such pads comprising a resilient foam in sheet form having a thickness from about 3/16" to about 5/16", such resilient foam pads being covered on their surface for contacting the body of a wearer with a non-abrasive fabric, located internally of the panty-type brief, extending over each hip side portion from a location contiguous to the waist opening to the leg opening, extending into the front riser to a location above the leg openings at their inner edges so as to cover the iliac crest area of the wearer, and extending into the rear riser to cover the posterior superior iliac spine area of the wearer, with the crotch and remaining areas of the front and rear risers above the crotch being free of protective pad covering.

2. The invention of claim 1 in which such protective pads have a curvilinear peripheral configuration defining a curvilinear border which is tapered in cross-sectional thickness toward its peripheral edge.

3. The invention of claim 1 in which the panty brief fabric comprises woven cotton fibers and the protective pads comprise high density foam rubber having tensile strength characteristics to resist tearing upon impact.

4. The invention of claim 2 in which such protective pads are made integral with such panty brief by serpentine-type stitching extending along such curvilinear border.

* * * * *